US008292526B2

(12) United States Patent
Sakai

(10) Patent No.: US 8,292,526 B2
(45) Date of Patent: Oct. 23, 2012

(54) THERMAL PRINTER

(75) Inventor: Hideki Sakai, Chiba (JP)

(73) Assignee: Seiko Instruments Inc. (JP)

( * ) Notice: Subject to any disclaimer, the term of this patent is extended or adjusted under 35 U.S.C. 154(b) by 514 days.

(21) Appl. No.: 12/583,737

(22) Filed: Aug. 25, 2009

(65) Prior Publication Data

US 2010/0054839 A1 Mar. 4, 2010

(30) Foreign Application Priority Data

Aug. 25, 2008 (JP) ..... 2008-215121

(51) Int. Cl.
*B41J 15/00* (2006.01)

(52) U.S. Cl. ..... 400/621; 400/611; 400/619; 271/9.1

(58) Field of Classification Search ..... 400/120.01, 400/120.16, 120.17, 621, 611, 619; 271/9.1
See application file for complete search history.

(56) References Cited

U.S. PATENT DOCUMENTS

| | | | | |
|---|---|---|---|---|
| 5,480,238 | A | 1/1996 | Nakano et al. | 400/120.04 |
| 6,135,591 | A | 10/2000 | Ikeda et al. | 347/104 |
| 6,520,634 | B2 * | 2/2003 | Yoshinaga et al. | 347/102 |
| 6,602,008 | B2 * | 8/2003 | Yamagishi et al. | 400/619 |

FOREIGN PATENT DOCUMENTS

EP 1354715 10/2003

* cited by examiner

*Primary Examiner* — Matthew G Marini
(74) *Attorney, Agent, or Firm* — Adams & Wilks

(57) ABSTRACT

A thermal printer has a thermal head for performing printing on a continuously fed recording sheet. A platen roller is mounted to undergo rotation for feeding the recording sheet between the platen roller and the thermal head. A cutting member cuts the recording sheet after printing is performed thereon by the thermal head. A sheet presenter mechanism discharges the recording sheet cut by the cutting member to the exterior. The sheet presenter mechanism is mounted to undergo movement to vary a discharge direction of the recording sheet.

5 Claims, 5 Drawing Sheets

THERMAL PRINTER

BACKGROUND OF THE INVENTION

1. Field of the Invention

The present invention relates to a thermal printer in which various types of information are printed on a recording sheet pulled out of roll paper.

2. Description of the Related Art

Thermal printers of various types are provided at present in which printing is performed by pressing a heated thermal head against a special recording sheet which undergoes a color change when heat is applied thereto.

In particular, smooth printing of characters and printing of a variety of graphics are possible without using a toner, an ink or the like, and hence the thermal printer is provided, for example, in a case such as a checkout machine at a parking or that of an oil dispenser at a self-service gas station, a ticket-vending machine provided in various restaurants, and an ATM (Automatic Teller Machine) at a bank to be suitably used for printing of various labels, receipts and tickets.

For example, in the case of the ticket-vending machine among the above-mentioned checkout machine, ticket-vending machine, ATM and the like, a purchased ticket and a receipt for proving the purchase of the ticket are sometimes issued by the same ticket-vending machine. In this case, the thermal printer described above cannot be used in a diversified manner, for example, to discharge the sheets printed with different print patterns from the single thermal printer while sorting the sheets according to the print patterns.

On the other hand, for example, in patent document JP 61-287661 A, in an image forming apparatus such as a copy machine, a laser printer, a liquid crystal printer, an ion printer, and a printing device, there is known a structure including a slide unit for moving a discharge tray in a direction (horizontal direction) different from a discharge direction of the sheets for each group of the discharged sheets to sort the discharged sheets into the groups.

In the above-mentioned structure of Patent Document 1, however, the structure allows the discharged sheets to be sorted by sliding the discharge tray. Therefore, it is necessary to provide a complex mechanism for sliding the discharge tray. As a result, an increase in apparatus size and an increase in manufacturing cost are brought about.

Moreover, when the above-mentioned structure of Patent Document 1 is used for, for example, the ticket-vending machine including the thermal printer provided in the case, it becomes hard for a user to receive the receipt or the ticket with the structure in which the discharge tray slides. Further, the discharge tray is exposed externally from the case and a large indefinite number of users touch the discharge tray in the case of the ticket-vending machine described above or the like, and hence a load is applied on the discharge tray to cause an early breakdown.

SUMMARY OF THE INVENTION

Therefore, the present invention is devised in view of the circumstances described above, and provides a thermal printer capable of sorting recording sheets with different print patterns without providing a complex mechanism to enable a user to easily receive a discharged sheet.

In order to solve the above-mentioned problem with conventional thermal printers, the present invention provides the following means.

A thermal printer of the present invention includes: a thermal head for performing printing on a continuously fed recording sheet; a platen roller for feeding the recording sheet through a rotation of the platen roller while interposing the recording sheet with the thermal head; a cutting member for cutting the recording sheet after the printing is performed thereon; and a presenter for discharging the recording sheet cut by the cutting member to exterior, characterized in that the presenter is configured to be movable to vary a discharge direction of the recording sheet.

According to the structure described above, the presenter is configured to be movable(i.e., mounted to undergo movement). Therefore, the recording sheets, on which the printing is performed by the thermal head, can be discharged in different discharge directions according to print patterns. Specifically, by varying the discharge direction of the recording sheet according to the print pattern, the recording sheet can be automatically sorted according to the print pattern. Thus, for example, at a ticket-vending machine or the like, a receipt and a ticket can be received in a separately-distinguished fashion.

In particular, by making the presenter mounted into a case of the ticket-vending machine or the like movable, the recording sheets, on which the printing has been performed, can be sorted. Therefore, in comparison with the case where the discharge tray provided outside of the case is configured to be movable (slidable) as in the conventional cases, it is not necessary to provide a complex mechanism. In addition, it is not necessary either to provide the thermal printers independent for the respective print patterns in the case. As a result, the sorting of the recording sheets can be realized with a simple structure while curbing the increase in apparatus size and the increase in manufacturing cost.

Moreover, the recording sheet, on which the printing has been performed with the thermal head, is discharged from a discharge port formed through the case of the ticket-vending machine or the like. Specifically, the recording sheet is discharged from a predetermined position, and hence it is easy for the user to receive the recording sheet to prevent the user from being puzzled by an operation of receiving the recording sheet. Further, the mechanism (presenter) for sorting the recording sheets is provided in the case, and hence the thermal printer itself is not exposed externally from the case. As a result, the user no longer touches the presenter, and hence a load is not applied to the thermal printer for the use of the thermal printer. Therefore, an early breakdown of the thermal printer can be prevented from occurring.

Further, the thermal printer of the present invention is characterized in that the presenter is configured to be turnable in a direction crossing a plane direction of the recording sheet, and the presenter is provided with an elastic member for biasing the presenter toward a one-end position and another-end position in a turning direction.

According to the structure described above, when the presenter is pushed down to exceed a neutral position to be located between the neutral position and the one-end position, the presenter is biased by the elastic member toward the one-end position. On the other hand, when the presenter is pushed up to exceed the neutral position to be located between the neutral position and the another-end position, the presenter is biased by the elastic member toward the another-end position. As a result, when the presenter exceeds the neutral position, the presenter can be automatically turned with ease to the one-end position or the lower-end position without subsequently requiring a pressure force. Then, by biasing the presenter toward the one-end position or the another-end position, the presenter can be surely oriented toward the one-end position or the another-end position. Therefore, the recording sheet can be surely discharged in a predetermined discharge direction with the simple structure.

Further, the thermal printer of the present invention is characterized in that a guide following movement of the presenter to bridge the platen roller and the presenter is provided between the platen roller and the presenter.

According to the structure described above, in the case where a distance between the presenter and the platen roller is large when, for example, the presenter is at the another-end position, the guide follows the turning of the presenter to bridge the presenter and the platen roller. As a result, the recording sheet fed from the platen roller moves over the guide to be guided to the presenter without fail, and hence the recording sheet does not fall between the presenter and the platen roller even if the presenter moves. Therefore, the recording sheet can be surely discharged to the exterior.

According to the thermal printer of the present invention, the presenter is configured to be movable. Therefore, the recording sheets, on which the printing is performed by the thermal head, can be discharged in different discharge directions according to print patterns. Specifically, by varying the discharge direction of the recording sheet according to the print pattern, the recording sheet can be automatically sorted according to the print pattern. Thus, for example, at a ticket-vending machine or the like, a receipt and a ticket can be received in a separately-distinguished fashion.

In particular, by making the presenter fixed into a case of the ticket-vending machine or the like movable, the recording sheets can be sorted. Therefore, in comparison with the case where the discharge tray provided outside of the case is configured to be movable (slidable) as in the conventional cases, it is not necessary to provide a complex mechanism. As a result, the sorting of the recording sheets can be realized with a simple structure while curbing the increase in apparatus size and the increase in manufacturing cost.

Moreover, the recording sheet, on which the printing has been performed with the thermal head, is discharged from a discharge port formed through the case of the ticket-vending machine or the like. Specifically, the recording sheet is discharged from a predetermined position, and hence it is easy for the user to receive the recording sheet to prevent the user from being puzzled by an operation of receiving the recording sheet. Further, the mechanism (presenter) for sorting the recording sheets is provided in the case, and hence the thermal printer itself is not exposed externally from the case. As a result, the user no longer touches the presenter, and hence a load is not applied to the thermal printer for the use of the thermal printer. Therefore, an early breakdown of the thermal printer can be prevented from occurring.

BRIEF DESCRIPTION OF THE DRAWINGS

In the accompanying drawings.

TIG. 4 is an enlarged view of a presenter located at an upper end position.

DETAILED DESCRIPTION OF THE PREFERRED EMBODIMENT (Thermal Printer)

Figure 1:
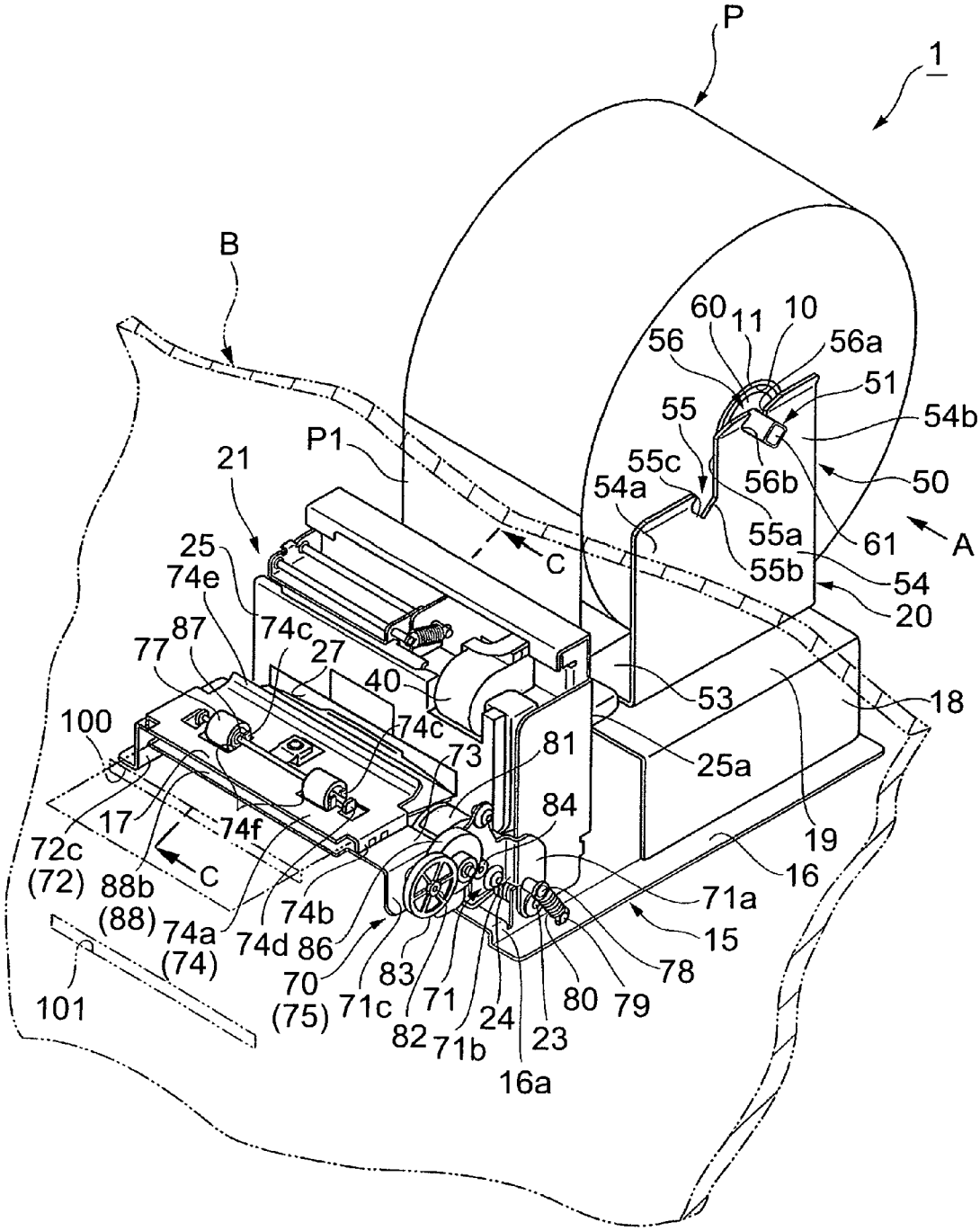
FIG. 1 is a perspective view of a thermal printer in an embodiment of the present invention.
Figure 2:
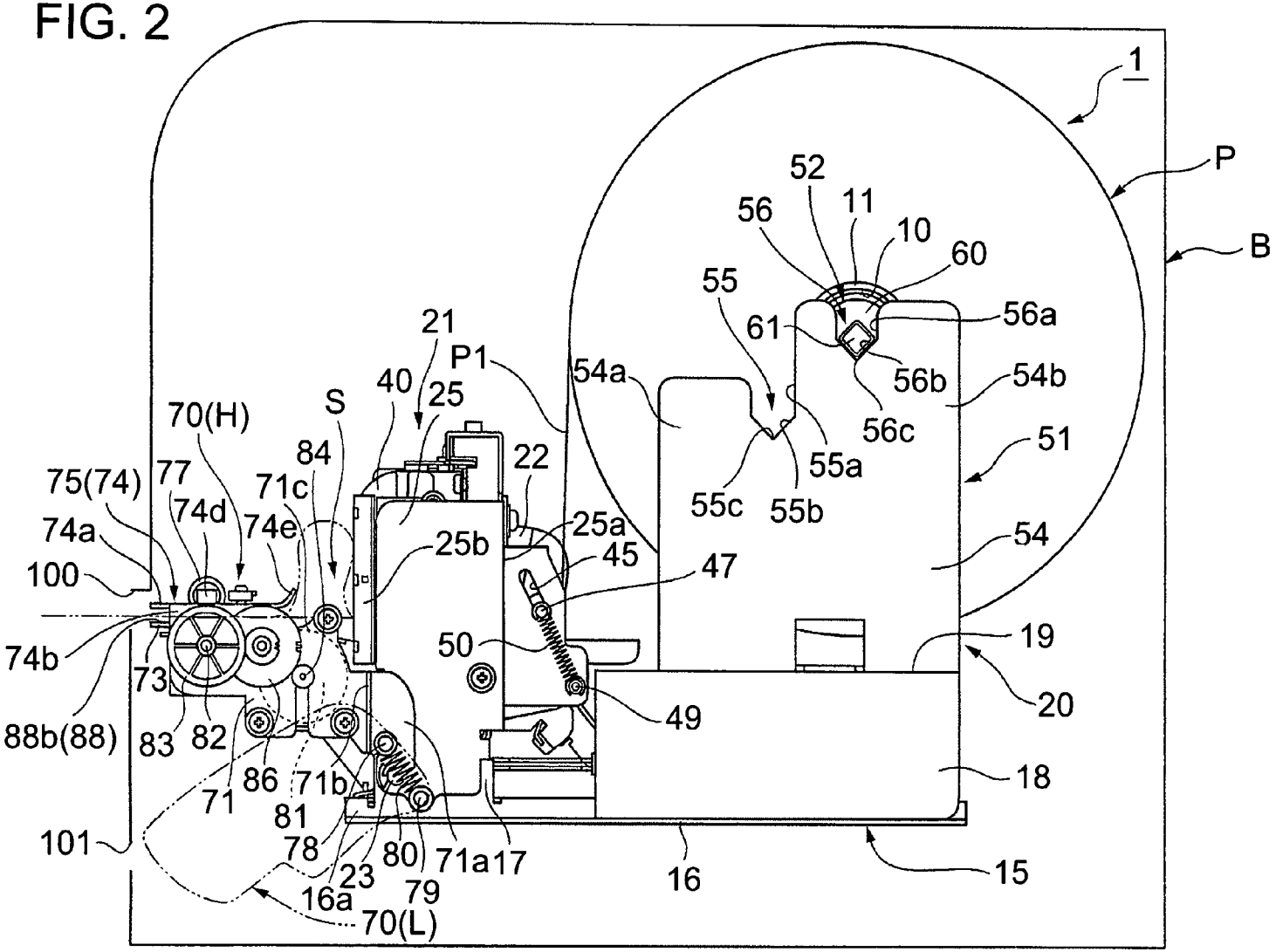
FIG. 2 is a view in the direction of arrow A shown in FIG. 1.

Next, an embodiment of the present invention is described based on FIGS. 1 to 5. FIG. 1 is a perspective view of a thermal printer. FIG. 2 is a view from an arrow A of FIG. 1. Note that, in FIGS. 1 to 5, illustrations thereof are abbreviated by appropriate omission of a part of the components, simplification of the configurations, and the like for facilitating the understanding of the invention.

As illustrated in FIGS. 1 and 2, in a thermal printer 1 according to this embodiment, roll paper P formed by winding a recording sheet P1 around a cylindrical core tube 11 having a hollow 10 therein is placed. Then, the thermal printer 1 performs printing on the recording sheet P1 pulled out from the roll paper P. Note that, as the roll paper P of this embodiment, the roll paper P having an outer diameter size of six inches is used.

The thermal printer 1 is incorporated into, for example, a ticket-vending machine provided in various restaurants or the like for use. In this embodiment, the thermal printer is provided in a case B (see FIG. 2) of the ticket-vending machine. On a front surface of the case B, slit-like discharge ports 100 and 101 are formed along a height direction of the case. The discharge ports 100 and 101 serve to discharge the recording sheet P1, on which the printing is performed by the thermal printer 1. A purchased ticket is discharged from one discharge port (for example, upper discharge port) 100, whereas a receipt for proving the purchase of the ticket is discharged from the other discharge port (for example, lower discharge port) 101. Specifically, the recording sheets P1, on which the printing is performed with different print patterns, are respectively discharged from the different discharge ports 100 and 101.

The thermal printer 1 includes a base 15 mounted in a casing (not shown), and a roll paper holding mechanism 20, a print unit 21, and a sheet presenter mechanism 70 (hereinafter "presenter"), which are provided on the base 15.

The base 15 is made of a metal material such as stainless steel, and includes a bottom panel 16, protruding portions 17 formed by bringing upright both sides of the bottom panel 16 on its one longitudinal end side (on left side of FIG. 2) in a height direction of the bottom panel 16 (in thickness direction of bottom panel 16), side panels 18 extending from both sides of the bottom panel 16 on its another longitudinal end side in the height direction of the bottom panel 16, and an upper panel 19 formed to be bridged between the side panels 18.

On the upper panel 19, the roll paper holding mechanism 20 for holding the roll paper P is provided. The recording sheet P1 is fed from the roll paper holding mechanism 20 toward the print unit 21 to allow the print unit 21 to perform printing on the recording sheet P1.

(Roll Paper Holding Mechanism)

The roll paper holding mechanism 20 described above includes the holder 51 provided on the upper panel 19 and the shaft 52 supported by the holder 51.

The holder 51 is a C-shaped member when viewed from the side, which includes a lower wall 53 in surface connection with the upper panel 19 and a pair of side walls 54 formed by vertically bending both ends of the lower wall 53 in the width direction to extend in a vertical direction. A space between the pair of side walls 54 forms a housing portion for housing the roll paper P therein.

Each of the side walls 54 includes a front portion 54*a* formed on the front side (side of the print unit 21) in the width direction and a rear portion 54*b* integrally formed with the front portion 54*a* on the rear side in the width direction to have a larger height than that of the front portion 54*a* in the height direction. A tip of each of the front portion 54*a* and the rear portion 54*b* is formed to be bent in a direction in which the space between the side walls 54 is enlarged (outward).

In a rear part of the front portion 54*a*, a first supporting portion 55 for supporting the shaft 52 is formed. The first supporting portion 55 is a groove formed by notching an upper edge of the front portion 54*a* in the height direction, and includes a vertical portion 55*a* corresponding to a vertically cut portion on the upper end side of the first supporting portion and a holding portion 55*b* having a V-shape when viewed from the side, which is formed to have a gradually reduced width of the groove on the lower end side. A width of the vertical portion 55*a* is formed to be longer than that of a diagonal of a cross section of each of poles 61 of the shaft 52 described below, which is vertical to an axial direction. The holding portion 55*b* is tapered downward while being inclined at an angle of, for example, about 45 degrees, and is a portion for holding the shaft 52. At a lower end of the holding portion 55*b*, an intersection point portion 55*c*, at which edges of the holding portion 55*b* intersect at an angle of, for example, 90 degrees, is formed. Specifically, the intersection point portion 55*c* of the first supporting portion 55 corresponds to a single intersection point at the lowermost portion of the first supporting portion 55.

On the other hand, a second supporting portion 56 for supporting the shaft 52 is formed at an intermediate position of each of the rear portions 54*b* in the width direction. The second supporting portion 56 has the same structure as that of the first supporting portion 55 described above. From an upper end, a vertical portion 56*a*, a holding portion 56*b*, and an intersection point portion 56*c* (see FIG. 2) are formed.

As described above, in the thermal printer 1 according to this embodiment, the two supporting portions 55 and 56 for supporting the shaft 52 are formed for the holder 51. An arbitrary one of the holding portion 55*b* of the first supporting portion 55 and the holding portion 56*b* of the second supporting portion 56 is made to support the shaft 52. In this case, the second supporting portion 56 is formed at the position higher than that of the first supporting portion 55 in the height direction. Specifically, the thermal printer 1 can switch between the supporting portions 55 and 56 for holding the roll paper P according to the outer diameter size of the roll paper P. More specifically, it is preferred to perform setting to cause the second supporting portions 56 to support the roll paper P having a relatively large diameter and to cause the first supporting portions 55 to support the roll paper P having a relatively small diameter. Note that, the roll paper P used in this embodiment has the outer diameter size of six inches, and hence the roll paper P is supported by the second supporting portions 56.

The shaft 52 is placed in the supporting portions (second supporting portions 56 in this embodiment) of the holder 51 in a drop-in manner (by a so-called drop-in method) while being inserted through the roll paper P, and includes a shaft main body 60 inserted into the hollow 10 of the core tube 11 of the roll paper P to support the roll paper P, and a pair of the poles 61 which can be housed within the second supporting portions 56 described above.

The shaft main body 60 has a columnar shape, and has an outer diameter smaller than an inner diameter of the core tube 11 of the roll paper P. Specifically, the hollow 10 of the core tube 11 of the roll paper P and an outer circumferential surface of the shaft main body 60 have a gap therebetween in a state where the shaft main body 60 is inserted through the hollow 10 of the core tube 11 of the roll paper P. As a result, the roll paper P is rotatable with respect to the shaft 52.

Each of the poles 61 has a surface extending from the center of each of both end surfaces of the shaft 52 to the axis direction of the shaft 52 and being perpendicular to the axis direction, the surface having an approximately-square shaped cross section, and each of the poles 61 has chamfered corners at its tip. Further, the shaft 52 is supported by the second supporting portions 56 of the holder 51 while the diagonal of the cross section perpendicular to the axis direction of the pole 61 is aligned with the vertical direction. More specifically, a top of the pole 61 is in conformity to the intersection point portion 56*c* of the second supporting portion 56, whereas two sides of the pole 61 are supported in a state of abutting against the holding portion 56*b* of the second supporting portion 56. As described above, the two sides of the pole 61 of the shaft 52 are supported by the holding portion 56*b* of the second supporting portion 56. Thus, even when a frictional force generated at the time of rotation of the roll paper P acts on the shaft 52, the shaft 52 does not rotate with respect to the holder 51. Specifically, the roll paper P is configured to be rotatable with respect to the shaft 52, whereas the shaft 52 is configured to be unrotatable with respect to the holder 51.

(Print Unit)

On the other hand, a turning shaft 23 is supported by the protruding portions 17 of the base 15 to bridge the protruding portions 17. The print unit 21 and the presenter 70 are supported turnably through the turning shaft 23. An elastic member 24 such as a torsion spring is provided to the turning shaft 23. One end side of the elastic member 24 abuts against an upper surface of the bottom panel 16, whereas the another end abuts against the print unit 21. As a result, the print unit 21 is biased in a clockwise direction. A turnable lever 22 (see FIG. 2) is provided on one side face of the casing 25 of the print unit 21 in its longitudinal direction (distant direction of the paper surface of FIG. 2). The lever 22 is locked to an unillustrated hook formed on one of the side panels 18 (on the far side of the paper surface of FIG. 2). Then, the lever 22 is turned to cancel the locking state between the lever 22 and the hook to allow the print unit 21 to be turned in a counterclockwise direction. For example, by turning the print unit 21 in the counterclockwise direction for replacing the paper or the like, a distance between the roll paper holding mechanism 20 and the print unit 21 is increased. As a result, a placement operation for placing the roll paper P or a pull-out operation for pulling out the recording sheet P1 from the placed roll paper P to the print unit 21 can be easily performed.

Figure 3:
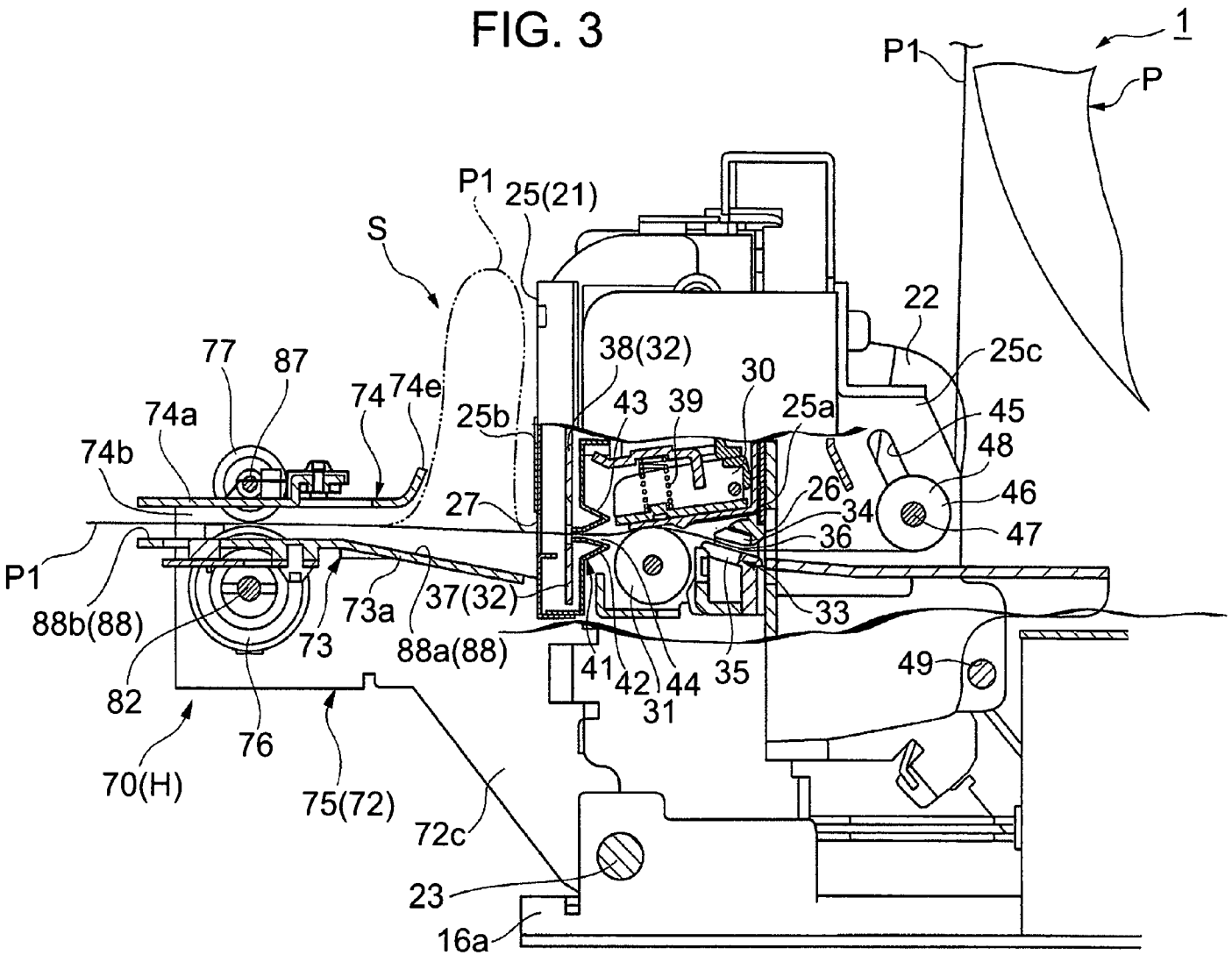
FIG. 3 is a partially cutaway sectional view of a print unit along a line C-C' shown in FIG. 1.

FIG. 3 is a sectional view along a line C-C' shown in FIG. 1, and is a partially cutaway sectional view of the print unit and the presenter.

As illustrated in FIGS. 1 to 3, a thermal head 30, a platen roller 31, and a cutting member 32 are provided in the casing 25 of the print unit 21. The casing 25 has a rectangular parallelepiped shape, and includes an entrance port 26 formed through a rear wall 25*a* in a width direction of the casing (through an end surface on the upstream side in a conveying direction of the recording sheet P1), through which the recording sheet P1 pulled out from the roll paper P is conveyed, and a discharge port 27 provided through a front wall 25*b* (through an end surface on the downstream side in the conveying direction of the recording sheet P1) to be opposed to the entrance port 26, from which the recording sheet P1 subjected to the printing in the print unit 21 is discharged. Each of the entrance port 26 and the discharge port 27 is a slit-like opening formed in a lower part of the casing 25 along the longitudinal direction of the casing 25. The thermal head 30, the platen roller 31, and the cutting member 32 are placed between the entrance port 26 and the discharge port 27.

A first guide member 33 for guiding the recording sheet P1 into the print unit 21 is provided to an inner circumferential edge of the entrance port 26. The first guide member 33 includes an upper guide 34 provided to an upper inner circumferential edge of the entrance port 26 and a lower guide 35 provided to a lower inner circumferential edge thereof. A path between the guides 34 and 35 serves as a guide path 36 through which the recording sheet P1 is conveyed. A proximal end of each of the guides 34 and 35 is provided to cover the inner circumferential edge of the entrance port 26. An opposed surface of each of the guides is chamfered in an arc-like shape. Further, each of the guides 34 and 35 extends toward the interior of the print unit 21 (thermal head 30) in an upwardly inclined manner from the proximal end to the top.

The thermal head 30 having an approximately rectangular cross section is provided above the upper guide 34 to be adjacent to the upper guide 34 of the first guide member 33, and is placed so that its longitudinal direction is aligned with a width direction of the recording sheet P1. The thermal head 30 performs the printing on the recording sheet P1 conveyed into the print unit 21, and includes a large number of heat-generating elements along the width direction of the recording sheet P1. Each of the heat-generating elements is controlled to generate heat based on a signal from a control section (not shown). By controlling the heat generation of the heat-generating elements, various types of characters, graphics and the like can be printed on a print surface of the recording sheet P1 (upper surface of the recording sheet P1 illustrated in FIG. 3). Further, the thermal head 30 is in a biased state toward the platen roller 31 by an elastic member 39 such as a coil spring.

The platen roller 31 is disposed to be opposite to the thermal head 30 in the state of pinching therebetween the recording sheet P1 guided by the first guide member 33 so that an outer circumferential surface thereof comes into contact with the thermal head 30. The platen roller 31 includes a driven gear (not shown) fixed at one end thereof, the driven gear being engaged with a gear transmission mechanism (not shown) rotated by a motor (stepping motor, for example) 40 illustrated in FIG. 1. With this structure, the platen roller 31 is rotated by the rotatably driving force from the motor 40, whereby the recording sheet P1 can be pulled out to the side of the discharge port 27 (downstream side) or drawn back to the side of the entrance port 26 (upstream side). Specifically, the motor 40 is forward-reverse rotatable by receiving the signal of the control section (not shown).

Further, on the downstream side of the platen roller 31 in the conveying direction, the cutting member 32 for cutting the recording sheet P1 which has passed through the thermal head 30 to be subjected to the printing is provided. The cutting member 32 includes a fixed blade 37 provided below the recording sheet P1 to be contactable with a back surface of the recording sheet P1, and a movable blade 38 which is provided on the side opposite to the fixed blade 37 through the recording sheet P1, and provided slidable in a direction approximately perpendicular (vertical) to the conveying direction of the recording sheet P1 by a motor (not shown) controlled by the control section. Note that, the thermal printer 1 includes the control section (not shown), in which various electronic devices are mounted, as described above. The control section outputs an electric signal or a control signal to the thermal head 30 or outputs the control signal to a motor (for example, motor 40) for driving the platen roller 31 and the cutting member 32 to perform overall control of each of the components.

A second guide member 41 for guiding the recording sheet P1, which has passed through the thermal head 30, to the cutting member 32 is provided between the cutting member 32 and the thermal head 30. The second guide member 41 includes, as in the case of the first guide member 33 described above, a lower guide 42 provided below the recording sheet P1 and an upper guide 43 provided on the side opposite to the lower guide 42 through the recording sheet P1. A path between the guides 42 and 43 is formed as a guide path 44 through which the recording sheet P1 passes. The guide path 44 is configured to have a gradually reducing width in the height direction from the entrance port 26 to the discharge port 27.

A pair of extending walls 25*c* extending from the rear wall 25*a* toward the another longitudinal end side (rear side) of the base 15 in a parallel manner are formed on the rear wall 25*a* of the casing 25 of the print unit 21. In an upper portion of each of the extending walls 25*c*, an elongated groove 45, which is inclined forward from the bottom to the top, is formed. A tension roller 46 is slidably supported in the elongated groove 45. The tension roller 46 includes supporting portions 47 formed on its both ends to be respectively inserted into the elongated grooves 45, and a roller main body 48 formed between the supporting portions 47, which has an outer diameter larger than that of each of the supporting portions 47.

The roller main body 48 is made of a rubber or the like, has a columnar shape, and has an outer circumferential surface contactable with the recording sheet P1. Then, the recording sheet P1 fed from the roll paper holding mechanism 20 passes below the roller main body 48, and is fed to the entrance port 26 of the print unit 21 after being bent at approximately 90 degrees by the roller main body 48.

On the other hand, in a lower portion of each of the extending walls 25*c* and on an extension of the elongated groove 45, a pole 49 provided to protrude from an outer surface of each of the extending walls 25*c* is formed. Between the supporting portion 47 of the tension roller 46 and the pole 49, an elastic member 50 such as a coil spring is interposed. The elastic members 50 bias the tension roller 46 in a direction for bringing the tension roller 46 and the poles 49 closer to each other. As a result, the tension roller 46 is located in lower end portions of the elongated grooves 45 as its initial position.

Then, the tension roller 46 supports the recording sheet P1 in such a manner that the recording sheet P1 is pressed down, specifically, the recording sheet P1 is biased to apply a tension thereto. As a result, the recording sheet P1 is guided to the print unit 21 while being applied with the tension by the tension roller 46 between the roll paper holding mechanism 20 and the print unit 21. The tension roller 46 slides on the elongated grooves 45 in a direction which intersects the conveying direction of the recording sheet P1 according to the tension applied to the recording sheet P1 bridged between the roll paper holding mechanism 20 and the print unit 21. As a result, the tension applied to the recording sheet P1 fed from the roll paper P can be adjusted between the roll paper holding mechanism 20 and the print unit 21.

(Presenter)

Figure 4:
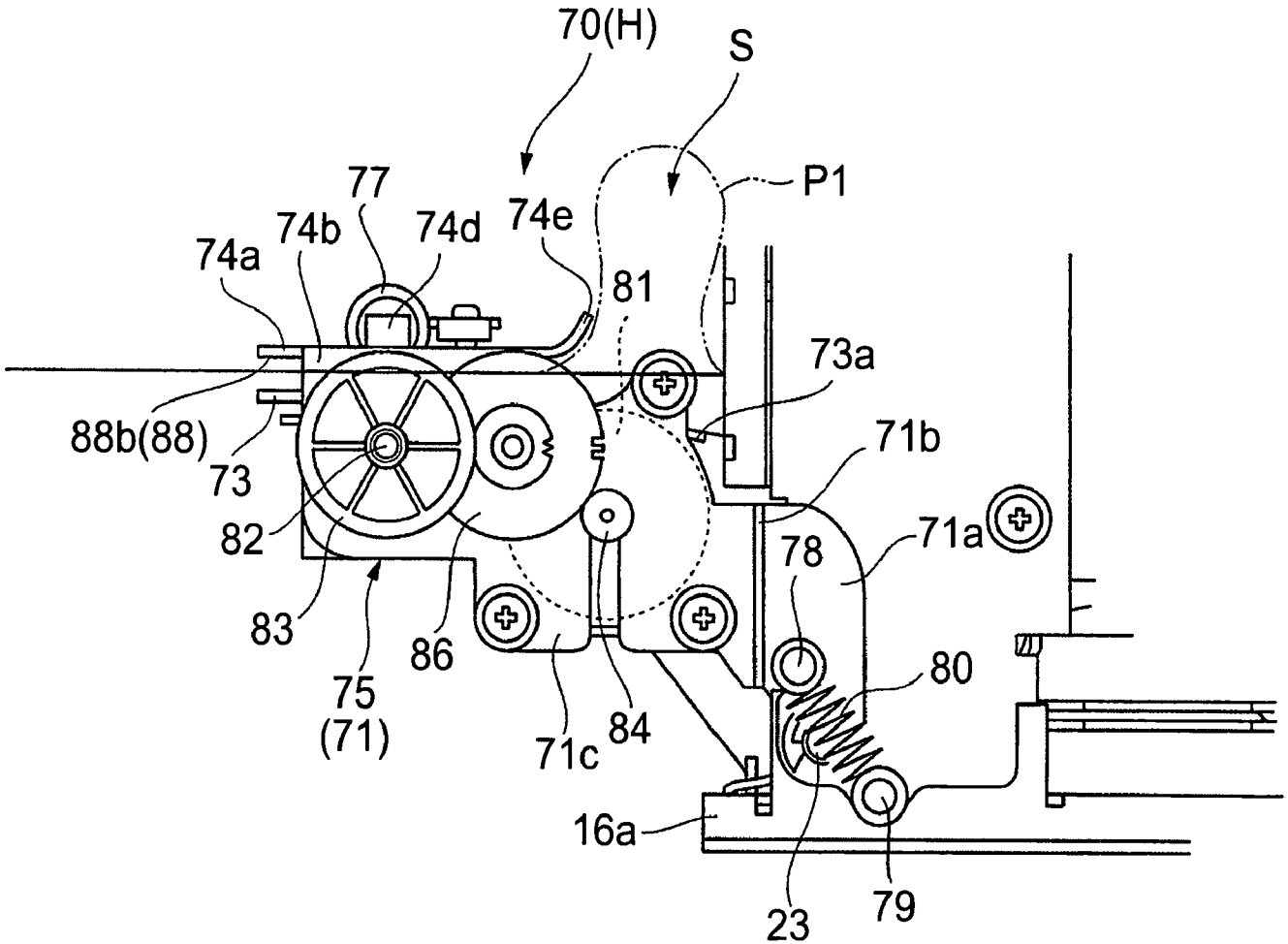
Figure 5:
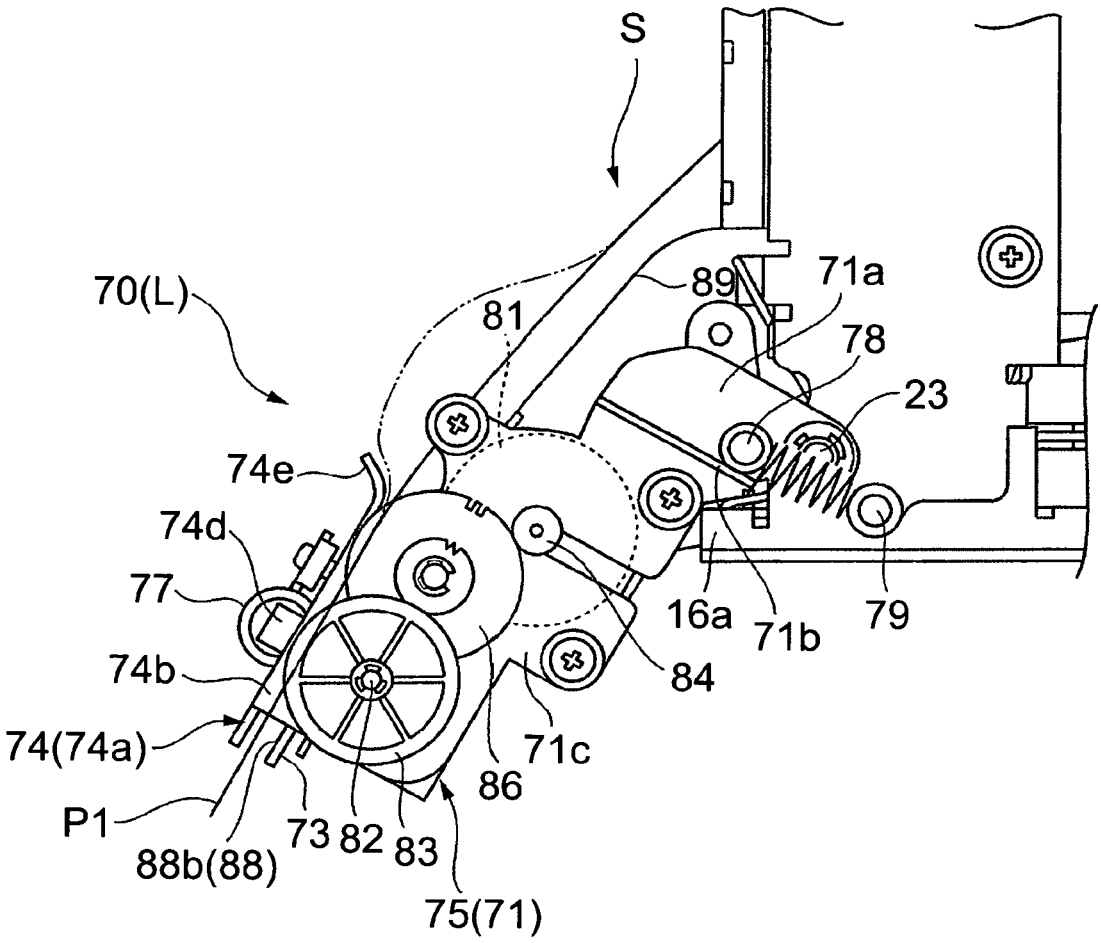
FIG. 5 is an enlarged view of the presenter located at a lower end position.

FIGS. 4 and 5 are enlarged side views of the presenter. FIG. 4 illustrates the presenter located at an upper end position, whereas FIG. 5 illustrates the presenter located at a lower end position.

As illustrated in FIGS. 1 to 5, the presenter 70 temporarily holds (loops) the recording sheet P1, which has been subjected to printing in the print unit 21 to be discharged from the discharge port 27 (see FIG. 1), and discharges the recording sheet P1 toward the discharge port 100 or 101 of the case B after the printing on the recording sheet P1 is completed and the recording sheet P1 is cut by the cutting member 32 (see a chain line shown in FIG. 3).

The presenter 70 includes: a frame 75 made of a metal; conveying rollers 76 fixed to the frame 75; and driven rollers 77 which follow the rotation of the conveying rollers 76 to make a rotation, and is supported turnably together with the print unit 21 by the turning shaft 23 described above. Note that, in the following description, the case where the presenter 70 is located at an upper end position H is described. The description is given while the upper side of the presenter 70 corresponds to the upper side of FIG. 4 and a side direction of the presenter 70 corresponds to a direction vertical to the paper surface of FIG. 4.

The frame 75 of the presenter 70 includes a pair of side frames 71 and 72, a lower frame 73 formed from a distal end portion 71*c* of the side frame 71 and a distal end portion 72*c* of the side frame 72 to bridge the side frames 71 and 72, and an upper frame 74 arranged to be opposed to the lower frame 73 with a gap with the lower frame 73.

The side frames 71 and 72 are flat plate-like members, and include a proximal end portion 71*a* formed to externally cover the side wall of the casing 25 of the print unit 21, a bent portion 71*b* formed by bending inward a leading end of the proximal end portion 71*a*, and the distal end portions 71*c* and 72*c* formed by bending the leading end of the bent portion 71*b* in parallel to an extending direction of the proximal end portions 71*a* toward the downstream side in the conveying direction of the recording sheet P1. The illustration of a proximal end portion and a bent portion of the side frame 72 is herein omitted.

The lower frame 73 is formed by bending the distal end portion 71*c* of the side frame 71 and the distal end portion 72*c* of the side frame 72 in the width direction of the recording sheet P1, and extends in the width direction of the recording sheet P1 between the side frames 71 and 72. In the region of the lower frame 73, a plurality of the conveying rollers 76 are arranged along its longitudinal direction (width direction of the recording sheet P1). The conveying rollers 76 are supported by a roller shaft 82 extending along the lower surface side of the lower frame 73. The conveying rollers 76 are arranged such that a part of the upper side of each of the conveying rollers 76 is exposed from the upper surface side of the lower frame 73 through a through hole (not shown) formed through the lower frame 73 along a thickness direction. The conveying roller 76 is made of a resin or the like, and an O-ring made of a rubber or the like is attached onto an outer circumferential surface thereof. Further, the roller shaft 82 described above is rotatably supported by the distal end portion 71*c* of the side frame 71 and the distal end portion 72*c* of the side frame 72. A driven gear 83 is fixed onto one end (on the side of the side frame 71) of the roller shaft 82. In this manner, a driving force from a motor 81 fixed onto the inner surface side of the side frame 71 is transmitted. Specifically, a gear 84 is fixed to a motor shaft of the motor 81. The structure is such that the driving force of the motor 81 is transmitted from the gear 84 through a gear transmission mechanism 86 to the driven gear 83 of the conveying rollers 76.

In a middle portion of the lower frame 73 in the conveying direction of the recording sheet P1, an inclined portion 73*a* (see FIG. 3) inclined downward from the downstream side (the left in FIG. 3) to the upstream side is formed. The inclined portion 73*a* extends to the position proximate to a lower inner circumferential edge of the entrance port 26 of the print unit 21.

The upper frame 74 includes a top panel portion 74*a* arranged to be opposed to the lower frame 73 in a parallel manner with a gap with an upper surface of the lower frame 73, and foot portions 74*b* formed by bending both sides of the top panel portion 74*a* to be connected to the lower frame 73. Specifically, between the top panel portion 74*a* of the upper frame 74 and the lower frame 73, a slit-like gap corresponding to a height size of each of the foot portions 74*b* is formed. The gap constitutes a conveyance path 88 through which the recording sheet P1 subjected to the printing by the print unit 21 is conveyed.

On the upper surface side of the top panel portion 74*a*, a plurality of (for example, two) driven rollers 77 are arranged along a longitudinal direction of the top panel portion 74*a* (width direction of the recording sheet P1). The driven rollers 77 are supported by a roller shaft 87 extending along the upper surface of the top panel portion 74*a* and are arranged such that a part of the lower side of each of the driven rollers 77 is exposed from the lower surface side of the top panel portion 74*a* through a through hole 74*f* formed in the top panel portion 74*a* along the thickness direction. The driven rollers 77 are arranged to be opposed to the conveying rollers 76 to be in contact with the outer circumferential surfaces of the conveying rollers 76 described above with the recording sheet P1 discharged from the discharge port 27 of the print unit 21 being interposed therebetween. Specifically, the driven rollers 77 follow the rotation of the conveying rollers 76 to make a rotation by a frictional force with the conveying rollers 76, and feed the recording sheet P1 toward the discharge port 100 or 101 in cooperation with the conveying rollers 76. The roller shaft 87 described above is rotatably supported by a protruding portion 74*c* cutting and bringing a circumferential edge of each of the through holes 74*f* up from the top panel portion 74*a*. Moreover, both ends of the roller shaft 87 are configured to be abuttable against protruding portions 74*d* formed by cutting and bringing both end sides of the top panel portion 74*a* up from the top panel portion 74*a*, thereby restraining the axial movement of the roller shaft 87.

Further, at the end of the top panel portion 74*a* on the downstream side (on the left in FIG. 3) in the conveying direction of the recording sheet P1, a curved portion 74*e* which is curved upward is formed. An inner surface of the curved portion 73*e* is in contact with an upper surface (print surface) in the state where the recording sheet P1 is held (see FIG. 3), and is formed to be shorter than the inclined portion 73*a* of the lower frame 73. As a result, a loop space S for looping the recording sheet P1 therein is formed between the curved portion 74*e* and the front wall 25*b* of the casing 25.

Further, the conveyance path 88 formed between the lower frame 73 and the upper frame 74 constitutes an entrance port 88*a* formed to be gradually tapered from a distal end of the inclined portion 73*a* of the lower frame 73 to its proximal end on the upstream side. On the other hand, on the downstream side, the conveyance path constitutes a discharge port 88*b* with a certain height, for discharging the recording sheet P1 which has been subjected to the printing to the discharge port 100 or 101 of the case B.

Here, the above-mentioned turning shaft 23 is inserted through a lower part of the proximal end portion 71*a* of the side frame 71. Further, the presenter 70 is configured to be turnable (undergo pivotal movement) about the turning shaft 23. Moreover, a pin 78 protruding outward from the proximal end portion 71*a* is provided above the turning shaft 23. Moreover, in a lower portion of the casing 25 of the print unit 21 described above, a pin 79 protruding outward from the side wall is also formed. An elastic member 80 such as a coil spring is connected between the pins 78 and 79 to bias the presenter 70 toward the upper end position H and the lower end position (turning position) L. Specifically, the elastic member 80 has substantially a natural length when the presenter 70 is located at the upper end position H or the lower end position L, and is in the most extended state (has a maximum elastic force) at an intermediate position between the upper end position H and the-lower end position L. Note that, the presenter 70 is automatically turnable by unillustrated turning means (for example, motor or the like). The structure is such that the discharge direction of the recording sheet P1 is determined based on the signal from the control section to turn the presenter 70 to the upper end position H or the lower end position L.

As described above, the presenter 70 of this embodiment is configured to be capable of changing its position to two positions, that is, the upper end position H and the lower end position L, through the turning shaft 23. More specifically, when the presenter 70 is at the upper end position H, the inner side of the bent portion 71*b* abuts against a stopper formed in a lower part of the casing 25 of the print unit 21 to allow the conveyance path 88 of the presenter 70, the discharge port 27 of the print unit 21, and the discharge port 100 of the case B to be located at approximately the same position in the height direction. Then, the recording sheet P1 fed to the presenter 70 passes through the conveyance path 88 to be discharged from the discharge port 100 of the case B, thereby enabling the user to receive the recording sheet P1.

On the other hand, as illustrated in FIG. 5, when the presenter 70 is at the lower end position L, the distal end portion 71*c* of the side frame 71 abuts against a stopper 16*a* formed at an end portion of the bottom panel 16. As a result, the conveyance path 88 is inclined toward the discharge port 101 of the case B. Then, the recording sheet P1 fed to the presenter 70 passes through the conveyance path 88 to be discharged from the discharge port 101 of the case B, thereby enabling the user to receive the recording sheet P1.

Moreover, on an upper surface of the inclined portion 73*a* of the lower frame 73 described above, there is provided a guide 89 for guiding the recording sheet P1 from the discharge port 27 of the print unit 21 to the entrance port 88*a* of the conveyance path 88 of the presenter 70. The guide 89 is a thin plate made of a resin or the like to have flexibility, which has one end connected to the upper surface of the inclined portion 71*a* in a cantilever fashion, and is configured to follow the turning of the presenter 70 to bridge the print unit 21 and the presenter 70. Specifically, the guide 89 is placed between the casing 25 of the print unit 21 and the bottom panel 16 when the presenter 70 is at the upper end position H, whereas the guide is pulled out from a space between the casing 25 of the print unit 21 and the bottom panel 16 to bridge the casing 25 and the presenter 70 when the presenter 70 is at the lower end position L (see FIG. 5).

(Method of Operating the Thermal Printer)

Next, a method of operating the thermal printer is described based on FIGS. 1 to 5. In the following description, a method of sorting the recording sheet P1 is mainly described.

First, as an initial state, it is supposed that the roll paper P is placed in the holder 51 and the recording sheet P1 of the roll paper P is guided from the entrance port 26 to the discharge port 27 of the print unit 21.

First, when a user operates an operating panel (not shown) of a ticket-vending machine, the control section of the thermal printer 1 controls each of the components for performing the printing on the recording sheet P1 according to a purpose of the operation, the amount of information to be printed or the like. Specifically, the control section drives the motor 40 to rotate the platen roller 31, while operating the heat-generating elements of the thermal head 30 based on the amount of information required to print the ticket. In addition, the presenter 70 is turned to determine the discharge direction of the recording sheet P1. In the following description, the case where the ticket and the receipt are sequentially printed in the print unit 21 is described. Therefore, it is supposed that the presenter 70 is located at the upper end position H in its initial state.

Then, when the recording sheet P1 passes under the thermal head 30 while being fed toward the downstream side by the platen roller 31, desired characters, graphics and the like are clearly printed on the recording sheet P1 by the heat-generating elements which generate heat. The recording sheet P1, on which the printing has been performed, passes through the guide path 44 of the second guide member 41 to be guided to the discharge port 27, and then enters the conveyance path 88 of the presenter 70.

At this time, the motor 81 for driving the conveying rollers 76 of the presenter 70 is not driven, and therefore, the conveying rollers 76 are not rotating. Specifically, an outer circumferential surface of each of the conveying roller 76 and that of each of the driven rollers 77 are in contact with each other in the conveyance path 88, and hence the conveying rollers 76 and the driven rollers 77 block the conveyance path 88. As a result, a leading end of the recording sheet P1 fed from the discharge port 27 of the print unit 21 comes into contact with the outer circumferential surfaces of the conveying rollers 76 or those of the driven rollers 77 in the conveyance path 88 to be stopped there.

On the other hand, the printing is continuously performed on the recording sheet P1 in the print unit 21, and the printed recording sheet P1 sequentially starts to be discharged from the discharge port 27. Then, the recording sheet P1 is held in an upward loop-like loosened state between the presenter 70 and the print unit 21, specifically, in the loop space S (see a chain line illustrated in FIG. 3). Then, the control section outputs the signal to the motor to allow the movable blade 38 to operate at timing at which the printed portion is completely discharged from the discharge port 27. As a result, the movable blade 38 slides along the fixed blade 37 to cut the recording sheet P1. Simultaneously with the cutting, the control section outputs the driving signal to the motor 81 for driving the conveying rollers 77. Based on the driving signal, the motor 81 is driven. Upon the driving of the motor 81, the driving force of the motor 81 is transmitted from the gear 84 of the motor 81 through the gear transmission mechanism 86 to the driven gear 83 of the conveying rollers 77. As a result, the conveying rollers 76 rotate in a direction of feeding the recording sheet P1 toward the downstream side (in the counterclockwise direction).

When the conveying rollers 76 rotate, the driven rollers 77 follow the rotation to also start rotating. As a result, the recording sheet P1 is conveyed toward the downstream side while being interposed between the conveying rollers 76 and the driven rollers 77. Then, the recording sheet P1, which has passed through the conveyance path 88, is discharged from the discharge port 100 of the case B through the discharge port 88*b* of the conveyance path 88. As a result, the user can receive the recording sheet P1, which has been wound into the roll paper P, as the ticket.

Upon termination of the printing of the ticket, the thermal printer 1 performs the printing for the receipt.

Here, the presenter 70 is first moved from the upper end position H to the lower end position L by the turning means. More specifically, when the turning means is operated to push down the presenter 70, an elastic force for biasing the presenter 70 toward the upper end position H is generated in the elastic member 80 of the presenter 70. Then, when the presenter 70 reaches the neutral position between the upper end position H and the lower end position L, the elastic member 80 becomes most extended. Beyond the neutral position, the presenter 70 is biased toward the lowed end position L. Specifically, the presenter 70 is biased toward the upper end position H by the elastic member 80 from the upper end position H to the neutral position, whereas the presenter 70 is biased toward the lower end position L by the elastic member 80 from the neutral position to the lower end position L. Note that, the above-mentioned operation is the same even in the case where the presenter 70 is moved from the lower end position L to the upper end position H.

Moreover, upon the turning of the presenter 70, the guide 89 provided on the upper surface of the inclined portion 73*a* of the presenter 70 follows the turning of the presenter 70 to be pulled out from the space between the casing 25 and the bottom panel 16. Then, the guide 89 is located to bridge the conveyance path 88 of the presenter 70 and the print unit 21.

After the presenter 70 is turned, the control section drives the motor 40 again to rotate the platen roller 31 while operating the heat-generating elements of the thermal head 30 based on the amount of information required to print the receipt.

Then, when the recording sheet P1 passes under the thermal head 30 while being fed toward the downstream side by the platen roller 31, the desired characters, graphics and the like are clearly printed on the recording sheet P1 by the heat-generating elements which generate heat. The recording sheet P1, on which the printing has been performed, passes through the guide path 44 of the second guide member 41 to be guided to the discharge port 27, and then enters the conveyance path 88 of the presenter 70 along the guide 89 bridging the print unit 21 and the presenter 70.

At this time, the conveying rollers 76 are not rotating as described above, and the leading end of the recording sheet P1 fed from the discharge port 27 of the print unit 21 comes into contact with the outer circumferential surfaces of the conveying rollers 76 or those of the driven rollers 77 in the conveyance path 88 to be stopped there. Therefore, the recording sheet P1 fed from the discharge port 27 is held in an upward loop-like loosened state in the loop space S (see a chain line illustrated in FIG. 5). Then, the control section operates the movable blade 38 at timing, at which the printed portion is completely discharged from the discharge port 27, to cut the recording sheet P1. Thereafter, the recording sheet P1 is conveyed toward the downstream side while being interposed between the conveying rollers 76 and the driven rollers 77. Then, the recording sheet P1, which has passed through the conveyance path 88, is discharged from the discharge port 101 of the case B through the discharge port 88*b* of the conveyance path 88. As a result, the user can receive the recording sheet P1, which has been wound into the roll paper P, as the receipt.

As described above, in this embodiment, the structure is such that the presenter 70 for discharging the recording sheet P1, on which the printing has been performed by the thermal head 30, to the exterior is provided on the downstream side of the print unit 21 in the conveying direction of the recording sheet P1 and the presenter 70 is turnably supported by the turning shaft 23.

According to this structure, the presenter 70 is configured to be turnable, and hence the recording sheet P1, on which the printing has been performed in the print unit 21, can be discharged in the different discharge directions (for example, to the discharge ports 100 and 101 of the case B) according to the print patterns. Specifically, by varying the discharge direction of the recording sheet P1 according to the print pattern, the recording sheet P1 can be automatically sorted according to the print pattern. Therefore, for example, at the ticket-vending machine or the like, the receipt and the ticket can be received in a separately-distinguished state.

In this embodiment, in particular, by making the presenter 70 mounted into the case B turnable, the recording sheet P1 can be sorted. Therefore, in comparison with the case where the discharge tray on the case side is configured to be movable (slidable) as in the conventional cases, it is not necessary to provide the complex mechanism. Moreover, it is not necessary either to provide the thermal printers 1 independent for the respective print patterns in the case B. As a result, the sorting of the recording sheet P1 can be realized with the simple structure while curbing the increase in apparatus size and in manufacturing cost.

Incidentally, the thermal printer 1 as described in this embodiment is generally provided in the case B such as the ticket-vending machine for use, as described above. When the structure, in which the discharge tray slides, is used for the ticket-vending machine including the thermal printer 1 provided within the case B, it becomes hard for the user to receive the receipt or the ticket. Further, the discharge tray is exposed externally from the case, and hence a large indefinite number of users touch the discharge tray in the case of the ticket-vending machine described above, thereby causing an early breakdown.

On the other hand, in this embodiment, the recording sheet P1, on which the printing has been performed by the print unit 21, is discharged from the discharge port 100 or 101 formed through the case B. Specifically, the recording sheet P1 is discharged from a predetermined position, and hence it is easy for the user to receive the recording sheet P1 and the user is not perplexed by an operation of receiving the recording sheet P1. Moreover, the mechanism (presenter 70) for sorting the recording sheet P1 is provided in the case B, and hence the thermal printer 1 itself is not exposed externally from the case B. As a result, the user does not touch the presenter 70, and hence a load is not applied to the thermal printer 1 for the use of the thermal printer 1. Therefore, the occurrence of the early breakdown of the thermal printer 1 can be prevented.

Moreover, the loop space S is formed between the print unit 21 and the presenter 70 in the thermal printer 1 of this embodiment, and hence the recording sheet P1 can be temporarily held without being discharged from the presenter 70 until the printing on the recording sheet P1 by the print unit 21 is completed and the recording sheet P1 is cut by the cutting member 32. As a result, the recording sheet P1, on which the printing is being performed, specifically, before being cut does not start to be discharged from the discharge port 100 or 101, and hence the recording sheet P1 is not forcibly pulled during the printing. Therefore, the load is not applied to the thermal printer 1 for the use of the thermal printer 1, and hence the step-out of the motor 40 of the platen roller 31, the misalignment of the recording sheet P1, a print error and the like can be prevented.

Moreover, the presenter 70 is biased by the elastic member 80 toward the upper end position H or the lower end position L. Therefore, when the presenter 70 is pushed down to exceed the neutral position to be located between the upper end position H and the lower end position L, the presenter 70 is biased by the elastic member 80 toward the lower end position. On the other hand, when the presenter 70 is pushed up to exceed the neutral position to be located between the upper end position H and the lower end position L, the presenter 70 is biased toward the upper end position H by the elastic member 80. In this manner, when the presenter 70 exceeds the neutral position, the presenter 70 can be automatically turned to the lower end position L with ease without requiring a pressure force. Then, by biasing the presenter 70 toward the upper end position H or the lower end position L, the presenter 70 can be surely oriented toward the upper end position H or the lower end position L. Therefore, the recording sheet P1 can be surely discharged in the predetermined discharge direction with the simple structure.

Further, in this embodiment, the structure is such that the guide 89 for guiding the recording sheet P1 discharged from the discharge port 27 of the print unit 21 to the conveyance path 88 of the presenter 70 is provided for the lower frame 73 of the presenter 70.

According to this structure, for example, when the presenter 70 is at the lower end position L, the guide 89 follows the turning of the presenter 70 to bridge the presenter 70 and the print unit 21 in the case where the distance between the presenter 70 and the print unit 21 is large. As a result, the recording sheet P1 discharged from the discharge port 27 of the print unit 21 moves over the guide 89 to be guided to the conveyance path 88 without fail, and hence the recording sheet P1 does not fall between the presenter 70 and the print unit 21 even when the presenter 70 is turned. Thus, the recording sheet P1 can be surely discharged to the exterior.

Note that, the technical scope of the present invention is not limited to the embodiment described above, and various changes are possible without departing from the spirit of the present invention.

For example, although the description has been made of the roll paper formed by winding the recording sheet around the core tube in this embodiment, the roll paper is not required to include the core tube as long as the roll paper has the hollow for axially supporting the roll paper.

Moreover, although the presenter of this embodiment is configured to be movable to two positions, that is, the upper end position and the lower end position, the number of the positions, to which the presenter can be moved, is not limited thereto and the presenter can be configured to be movable to three or more positions. In this case, a structure for moving the presenter only by turning means such as a motor is also possible.

Further, although the structure for turnably supporting the presenter has been described in the embodiment described above, the structure is not limited thereto. A change in design can be appropriately made to configure the presenter, for example, to be slidable in a direction crossing the conveying direction of the recording sheet (for example, in vertical direction).

Moreover, the structure may be such that the upper end position of the presenter is set as a home position and the presenter returns to the home position for each printing. Specifically, the structure for repeating an operation of moving the presenter in a desired discharge direction after performing the printing at the home position and bringing the presenter back to the home position after the discharge is also possible.

What is claimed is:

1. A thermal printer, comprising:

a thermal head for performing printing on a continuously fed recording sheet;

a platen roller mounted to undergo rotation for feeding the recording sheet between the platen roller and the thermal head;

a cutting member for cutting the recording sheet after printing is performed thereon by the thermal head;

a presenter for discharging the recording sheet cut by the cutting member to the exterior, the presenter being mounted to undergo movement to vary a discharge direction of the recording sheet; and biasing means for biasing the presenter in a turning direction between a first end position and a second end position via a neutral position of the presenter;

wherein when the presenter is turned in a direction toward the second end position and exceeds the neutral position so that the presenter is positioned between the neutral position and the second end position, the biasing means biases the presenter toward the second end position; and wherein when the presenter is turned in a direction toward the first end position and exceeds the neutral position so that the presenter is positioned between the neutral position and the first end position, the biasing means biases the presenter toward the first end position.

2. A thermal printer according to claim 1; further comprising a guide mounted between the platen roller and the presenter for undergoing movement with the presenter to bridge the platen roller and the presenter provided between the platen roller and the presenter.

3. A thermal printer according to claim 2; wherein the guide is disposed between the platen roller and the presenter.

4. A thermal printer according to claim 1; further comprising a casing housing the thermal head, platen roller, cutting member and presenter.

5. A thermal printer according to claim 1; further comprising a guide mounted to undergo movement with the presenter for bridging the platen roller and the presenter when the presenter is disposed in the second end position.

* * * * *